United States Patent [19]

Ragland, Jr.

[11] Patent Number: 4,950,941

[45] Date of Patent: Aug. 21, 1990

[54] COLOR PICTURE TUBE HAVING IMPROVED SHADOW MASK-FRAME ASSEMBLY SUPPORT

[75] Inventor: Frank R. Ragland, Jr., Lancaster, Pa.

[73] Assignee: RCA Licensing Corporation, Princeton, N.J.

[21] Appl. No.: 383,396

[22] Filed: Jul. 21, 1989

[51] Int. Cl.[5] ..... H05J 29/07

[52] U.S. Cl. ..... 313/404; 313/406

[58] Field of Search ..... 313/402, 404, 406

[56] References Cited

U.S. PATENT DOCUMENTS

| | | | |
|---|---|---|---|
| 3,529,199 | 9/1970 | Duistermaat et al. | 313/85 |
| 4,317,064 | 2/1982 | Dougherty | 313/406 |
| 4,723,088 | 2/1988 | Sone et al. | 313/404 |
| 4,728,853 | 3/1988 | Sone et al. | 313/406 |
| 4,827,180 | 5/1989 | Sone et al. | 313/404 |

FOREIGN PATENT DOCUMENTS

| | | | |
|---|---|---|---|
| 63-43242 | 2/1988 | Japan | 313/402 |

*Primary Examiner*—Sandra L. O'Shea

*Attorney, Agent, or Firm*—Joseph S. Tripoli; Dennis H. Irlbeck

[57] ABSTRACT

The present invention provides an improvement in color picture tubes including an evacuated glass envelope having a rectangular faceplate panel. The panel includes a shadow mask assembly mounted therein by support means located at peripherally spaced positions within the panel. The support means at each of the spaced positions includes a stud attached to the glass envelope, a spring and a plate. The spring has an aperture therein that engages the stud. The spring is attached to the plate, and the plate is welded to the mask assembly. The improvement comprises the plate being welded to the mask assembly at only one location. This location is on a line, perpendicular to the plate, that passes through the center of the aperture in the spring.

3 Claims, 2 Drawing Sheets

COLOR PICTURE TUBE HAVING IMPROVED SHADOW MASK-FRAME ASSEMBLY SUPPORT

This invention relates to color picture tubes of the type having a shadow mask attached to a peripheral frame which is suspended in relation to a cathodoluminescent screen and, particularly, to improve means for suspending a mask-frame assembly in such a tube.

BACKGROUND OF THE INVENTION

In most current color picture tube types, a peripheral frame supporting a shadow mask is suspended in a faceplate panel by means of springs that are welded either directly to the frame or to plates which in turn are welded to the frame. In the directly welded version, the springs are made of bimetallic materials; and in the plate version, the plates are bimetallic. As the springs or plates become heated by transfer of heat from the mask through the frame, the bimetallic materials expand differently, thereby bending the springs or plates to cause movement of the mask-frame assembly toward a screen disposed on the panel.

It is common to use either three or four springs to support a mask-frame assembly within a rectangular faceplate panel of a tube. In a three-spring support system, one spring is usually located at the upper center of the mask, and the other two springs are located along the sides of the tube between the centers of the sides of the mask and the lower two corners of the mask. In a four-spring support system, springs are usually located at the top and bottom centers of the mask and at the left and right centers of the mask. In both the three- and four-spring support systems, as described above, it is possible for the mask-frame assembly to twist slightly and shift relative to the faceplate, during manufacturing and tube operation.

A known means for minimizing twisting and shifting of a mask-frame assembly uses spring supports at the four corners of the frame. Embodiments for achieving such corner support are shown in U.S. Pat. No. 4,723,088, issued to Sone et al. on Feb. 2, 1988, and in U.S. Pat. No. 4,728,853, issued to Sone et al. on Mar. 1, 1988.

U.S. Pat. No. 4,723,088 shows a mask frame having truncated corners with supports at each corner. The supports are bent plates including three sections A first section is welded to the frame. A second section extends at an angle from the first section toward a skirt of a faceplate panel. A third section extends from the second section. The third section includes an aperture that engages a metal stud that is embedded in the panel sidewall.

U.S. Pat. No. 4,728,853 discloses a support which includes two members welded together. One member, having a flat plate shape, is welded at several separated points to a mask frame. The second member includes three sections. A first section is welded to the first member. A second section angles from the first section, and an apertured third section engages a support stud in the panel sidewall.

SUMMARY OF THE INVENTION

The present invention provides an improvement in color picture tubes including an evacuated glass envelope having a rectangular faceplate panel. The panel includes a shadow mask assembly mounted therein by support means located at peripherally spaced positions within the panel. The support means at each of the spaced positions includes a stud attached to the glass envelope, a spring and a plate. The spring has an aperture therein that engages the stud. The spring is attached to the plate, and the plate is welded to the mask assembly. The improvement comprises the plate being welded to the mask assembly at only one location. This location is on a line, perpendicular to the plate, that passes through the center of the aperture in the spring.

DETAILED DESCRIPTION OF THE PREFERRED EMBODIMENT

Figure 1:
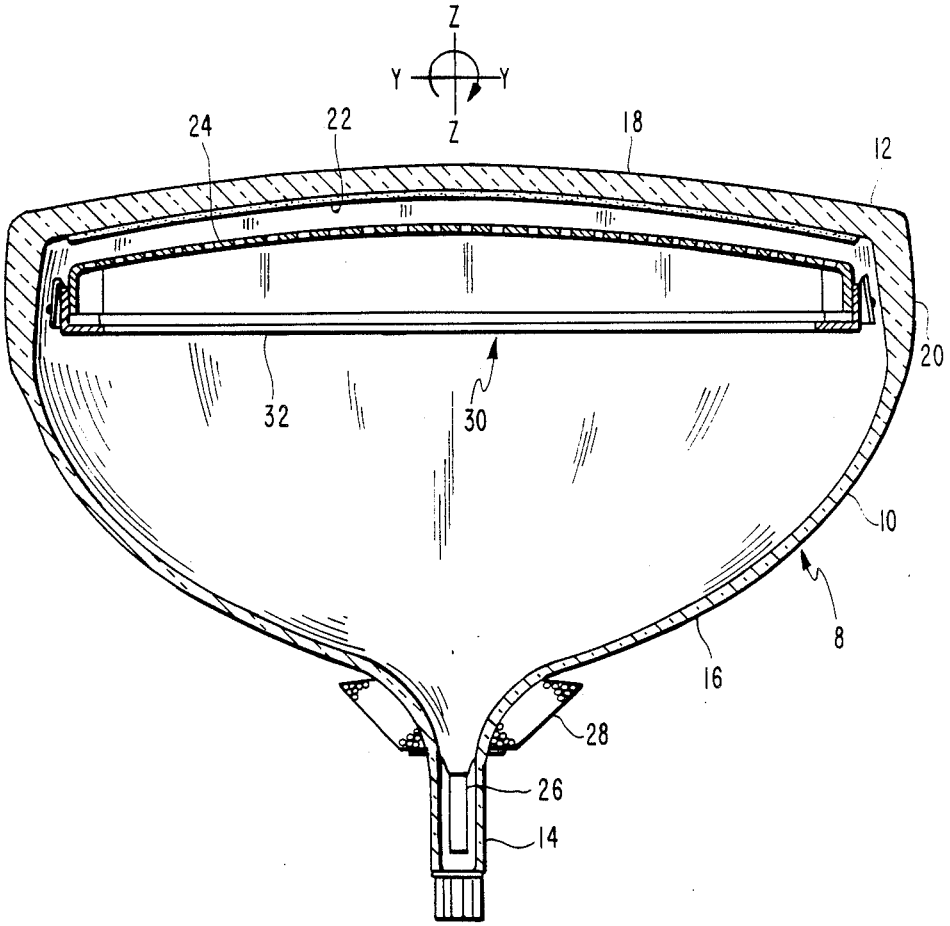
FIG. 1 is an axially sectioned side view of a color picture tube the present invention.

FIG. 1 shows a rectangular color picture tube B having a glass envelope 10, comprising a rectangular faceplate panel 12 and a tubular neck 14 connected by a rectangular funnel 16. The panel 12 comprises a viewing faceplate 18 and a peripheral flange or sidewall 20 which is sealed to the funnel 16. The faceplate panel 12 includes two orthogonal axes: a major axis X—X, parallel to its wider dimension (usually horizontal), and a minor axis Y—Y, parallel to its narrower dimension (usually vertical). The major and minor axes are perpendicular to the central longitudinal axis Z—Z of the tube which passes through the center of the neck 14 and the center of the panel 12. A mosaic three-color phosphor screen 22 is carried by the inner surface of the faceplate 18. The screen preferably is a line screen with the phosphor lines extending substantially parallel to the minor axis Y—Y. Alternatively, the screen may be a dot screen. A multiapertured color selection electrode or shadow mask 24 is removably mounted, by improved means, in predetermined spaced relation to the screen 22. An electron gun 26 is centrally mounted within the neck 14, to generate and direct three electron beams along convergent paths through the mask 24 to the screen 22.

The tube of FIG. 1 is designed to be used with an external magnetic deflection yoke, such as the yoke 2S, located in the neighborhood of the funnel-to-neck junction. When activated, the yoke 28 subjects the three beams to magnetic fields which cause the beams to scan horizontally and vertically in a rectangular raster over the screen 22.

Figure 3:
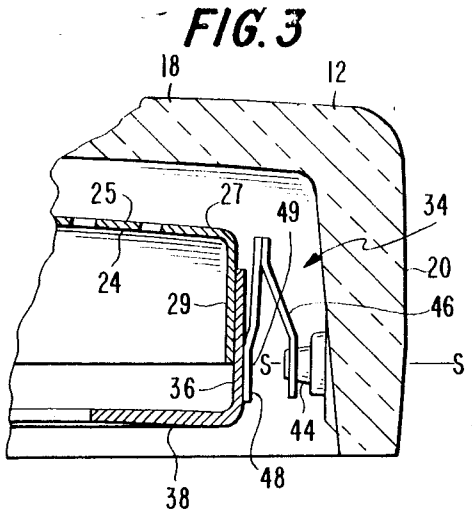
FIG. 3 is a partial sectional view of a corner of the faceplate panel mask-frame assembly of FIG. 2.
Figure 4:
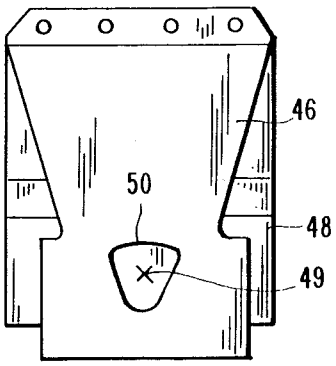
FIG. 4 is a plan view of a spring and plate.
Figure 2:
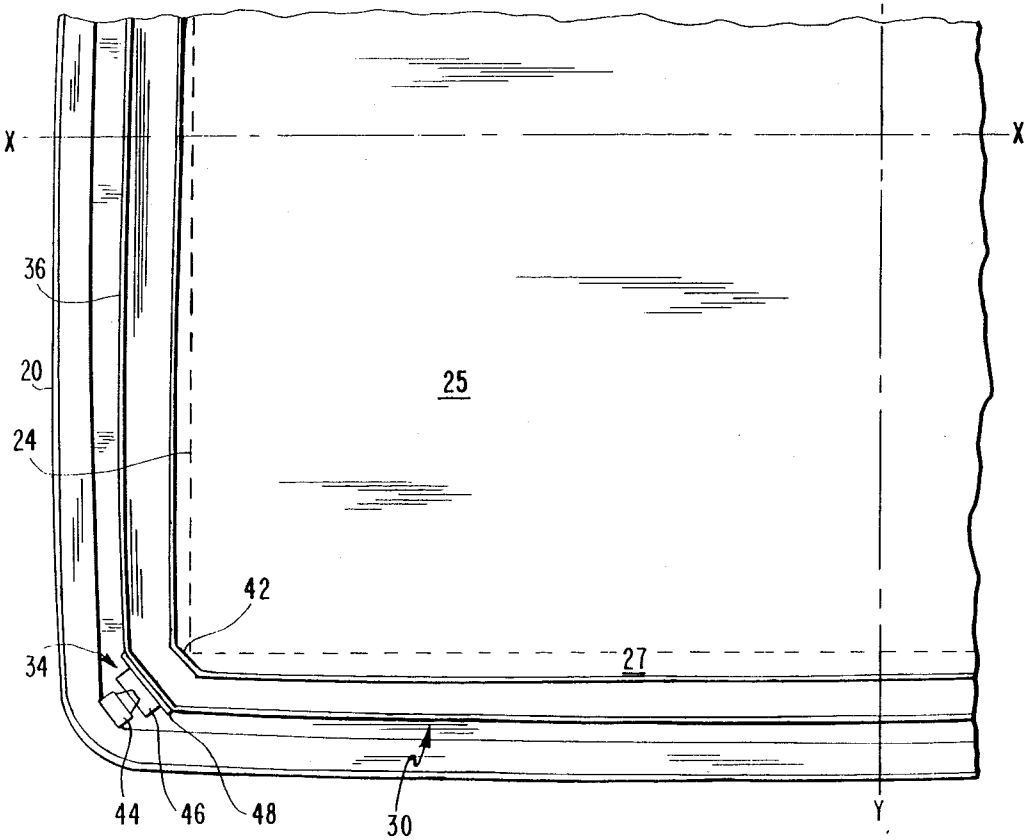
FIG. 2 is a bottom view of a quadrant of the faceplate panel assembly of the tube of FIG. 1.

The shadow mask 24 is part of a mask-frame assembly 30 that also includes a peripheral frame 32. The mask-frame assembly 30 is shown positioned within the faceplate panel 12 in FIGS. 1, 2 and 3. The mask-frame assembly 30 is mounted to the panel 12 by four improved support means 34 shown in FIGS. 2, 3 and 4.

The frame 32 includes two substantially perpendicular flanges, a first flange 36 and a second flange 38, in an L-shaped cross-sectional configuration. The first flange 36 extends from the second flange 38 in a direction toward the screen 22. The second flange 38 extends from the first flange 36 in a direction toward the central longitudinal axis Z—Z of the tube 8. The four corners 42 of the frame 32 are truncated, being angled approximately perpendicularly to the diagonal directions of the frame.

The shadow mask 24 includes a curved apertured portion 25, an imperforate border portion 27 surrounding the apertured portion 25, and a skirt portion 29 bent back from the border portion 27 and extending away from the screen 22. The mask 24 is telescoped within or set inside the frame 32 and welded to the inside surface of the first flange 36.

Mask-frame assembly support means 34 are included at each of the four corners of the frame and panel. Each support means 34 includes a stud 44, a spring 46 and a plate 48. Each stud 44 is a conically-shaped metal member that is attached to the panel sidewall 20. Each plate 38 is welded near one end to the flange 36 at a truncated corner 42 of the frame 32. The spring 46 is attached at one of its ends to the other end of the plate 48. An aperture 50, near the free end of each spring 46, engages the conical tip of a stud 44.

Unlike the prior art, each plate 48, according to the present invention, is welded to a flange 36 at only a single location 49. This weld location 49 is on an extension of the central longitudinal axis S—S of the corresponding stud 44. Preferably, the single weld is formed elongated and larger than are each of the multiple welds used in the prior art.

The above-described means of attaching each support means to the frame at a single location precludes a need for multiple welds, by controlling the forces at the weld. A need for multiple welds arises when there is a moment in the plane of the flattened area of the frame that must be resisted by the welds. The present means of attachment eliminates or minimizes this moment, by placing a single large weld in coaxial alignment with the corresponding panel stud. That is, a line that is perpendicular to the flattened area of the frame and passes through the center of the weld also passes through the center of the support spring hole, when the spring is seated on the panel stud. The area of the weld and the contact area between the flattened area and the other part is more than adequate to resist the remaining moments and forces.

Although the present invention has been described with respect to a tube having a corner-mounted shadow mask therein, it should be understood that the invention may alternatively be applied to a tube having a shadow mask mounted along the major and minor axes within a tube faceplate panel. Furthermore, the present invention may be applied to a tube in which peripheral reinforcement of a shadow mask is provided integrally with the mask, without use of a separate frame. In addition, the present invention may be applied to a mask support system having other than four support locations.

What is claimed is:

1. In a color picture tube including an evacuated glass envelope having a rectangular faceplate panel, said panel including a shadow mask assembly mounted therein by support means located at peripherally spaced positions within said panel, said support means at each of said spaced positions including a stud attached to said glass envelope, a spring and a plate, said spring being attached to said plate and having an aperture therein engaging said stud, and said plate being welded to said mask assembly, the improvement comprising said plate being welded to said mask assembly at only one location, said one location being on a line, perpendicular to said plate, that passes through the center of said aperture in said spring.

2. In a color picture tube including an evacuated glass envelope having a rectangular faceplate panel, said panel including a shadow mask welded to a peripheral frame mounted therein by support means located at four peripherally spaced positions within said panel, said support means at each of said four positions including a stud attached to said glass envelope, a spring and a plate, said spring being welded to said plate and having an aperture therein engaging said stud, and said plate being welded to said frame, the improvement comprising said plate being welded to said frame at only one location, said one location being on a line, perpendicular to said plate, that passes through the center of said aperture in said spring.

3. In a color picture tube including an evacuated glass envelope having a rectangular faceplate panel, said panel including a shadow mask welded to a peripheral frame mounted therein by support means located at the four corners of said panel, said support means at each of said four corners including a stud attached to said glass envelope, a spring and a plate, said spring being welded to said plate and having an aperture therein engaging said stud, and said plate being welded to said frame, the improvement comprising said plate being welded to said frame at only one location, said one location being on a line, perpendicular to said plate, that passes through the center of said aperture in said spring.

* * * * *